US009098052B2

(12) United States Patent
Taoka

(10) Patent No.: US 9,098,052 B2
(45) Date of Patent: Aug. 4, 2015

(54) IMAGE FORMING APPARATUS

(71) Applicant: CANON KABUSHIKI KAISHA, Tokyo (JP)

(72) Inventor: Keitaro Taoka, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/866,236

(22) Filed: Apr. 19, 2013

(65) Prior Publication Data

US 2013/0287438 A1 Oct. 31, 2013

(30) Foreign Application Priority Data

Apr. 27, 2012 (JP) ..... 2012-103006

(51) Int. Cl.
*G03G 15/16* (2006.01)
*G03G 21/16* (2006.01)
*G03G 15/00* (2006.01)

(52) U.S. Cl.
CPC ..... *G03G 21/16* (2013.01); *G03G 15/167* (2013.01); *G03G 15/5058* (2013.01); *G03G 2215/0129* (2013.01)

(58) Field of Classification Search
CPC ..... G03G 15/0136; G03G 15/1615; G03G 21/1638; G03G 2215/004; G03G 2215/0193
USPC ..... 399/121, 313, 317
See application file for complete search history.

(56) References Cited

U.S. PATENT DOCUMENTS

| | | | | |
|---|---|---|---|---|
| 2004/0013452 | A1* | 1/2004 | Choi | 399/313 |
| 2007/0217801 | A1* | 9/2007 | Tsuboi et al. | 399/49 |
| 2008/0226358 | A1* | 9/2008 | Hanashima et al. | 399/299 |
| 2008/0240800 | A1* | 10/2008 | Furukawa | 399/302 |
| 2009/0129815 | A1* | 5/2009 | Kouzu | 399/121 |
| 2009/0245864 | A1* | 10/2009 | Nakura et al. | 399/121 |
| 2010/0061752 | A1* | 3/2010 | Sudo et al. | 399/66 |
| 2011/0158690 | A1* | 6/2011 | Mimbu et al. | 399/121 |
| 2012/0050436 | A1* | 3/2012 | Park et al. | 347/103 |
| 2012/0230706 | A1* | 9/2012 | Yoshida | 399/27 |
| 2014/0086605 | A1* | 3/2014 | Yoshida et al. | 399/45 |

FOREIGN PATENT DOCUMENTS

JP 2010-117636 A 5/2010

* cited by examiner

*Primary Examiner* — Clayton E Laballe
*Assistant Examiner* — Ruifeng Pu
(74) *Attorney, Agent, or Firm* — Fitzpatrick, Cella, Harper & Scinto

(57) ABSTRACT

An image forming apparatus includes an image bearing member, a transfer member configured to transfer a toner image formed on the image bearing member onto a recording material, and a contact-and-separation unit configured to move the transfer member to a contact position where the transfer member contacts the image bearing member and a spacing position where the transfer member is separated from the image bearing member. A control portion controls a driving unit when the transfer member is moved from the contact position to the spacing position by using a phase range and a rotational direction of a cam of the contact-and-separation unit, in which a distance between an outer circumference at an abutted portion of a supporting member and a rotation center of the cam continuously increases with rotation of the cam.

4 Claims, 11 Drawing Sheets

IMAGE FORMING APPARATUS

FIELD OF THE INVENTION AND RELATED ART

The present invention relates to an image forming apparatus such as a copying machine, a facsimile machine, a printer or a multi-function machine of these machines, and particularly relates to a structure for moving a transfer member, for transferring a toner image from an image bearing member onto a recording material, toward and away from the image bearing member.

As the image forming apparatus such as the copying machine, the facsimile machine or the printer, the image forming apparatus of an intermediary transfer type in which a formed image is primary-transferred from a photosensitive drum onto an intermediary transfer belt and then is secondary-transferred from the intermediary transfer belt onto a recording material has been known. In such an image forming apparatus, in order to access to a transfer conveyance portion when paper jam clearance or maintenance of the apparatus is made, a conveyance frame is constituted so as to be capable of being pulled out from an image forming apparatus main assembly. From viewpoints of an inserting and extracting property and a jam clearance property, in the case where the conveyance frame is extracted and inserted or in the case where the jam clearance is made, there is a need to move a secondary transfer roller, contacted to an intermediary transfer belt when the image is transferred onto the recording material, away from the intermediary transfer belt.

Further, in order to stabilize an image quality, an image adjusting sequence such as image density, adjustment or color misregistration adjustment is performed in synchronism with a predetermined print number or a predetermined print time. In this image adjusting sequence, an adjusting toner image (patch) is transferred onto the intermediary transfer belt and is read by a patch sensor and then on the basis of a result of the reading, an image is adjusted. This patch is, after being transferred as a toner image at a primary transfer portion and then being read by the patch sensor, passed through a secondary transfer portion and then is removed from the intermediary transfer belt at a cleaning portion of the intermediary transfer belt.

Such an image adjusting sequence is performed in an interruption manner during rest of image formation between a job and a subsequent job or during an interval (sheet interval) between a normal image and a subsequent normal image during execution of the job. In Japanese Laid-Open Patent Application (JP-A) 2010-117636, a structure for moving (spacing), when a patch passes through the secondary transfer portion, a secondary transfer outer roller away from the intermediary transfer belt in order to avoid contamination of the secondary transfer outer roller with the patch is disclosed.

However, in a conventional structure described in JP-A 2010-117636, in the case where a spacing operation of the secondary transfer outer roller is performed when the image adjusting sequence is performed at the sheet interval during the execution of the job, vibration generated by the spacing operation adversely affects the image formation. For this reason, in the case of the conventional structure, when the image adjusting sequence is performed at the sheet interval, there is a need to take into consideration a convergence time of the vibration generated by the spacing operation.

For example, in a structure in which the secondary transfer outer roller is contacted to the intermediary transfer belt by an urging force of a compression spring, the case where a cam is rotated to space the secondary transfer outer roller against the urging force of the compression spring is considered. In this structure, when the secondary transfer outer roller is spaced from the intermediary transfer belt, the cam has been rotated conventionally, until a patch where a rotational load torque of the cam by the urging force of the compression spring is eliminated, in either case of the jam clearance and the image adjusting sequence. That is, in order to perform the jam clearance or the like, in the case where the image forming apparatus is stopped in a state in which the rotational load torque is exerted on the cam, a motor torque is eliminated when a main power of the apparatus is turned off, so that the cam is rotated by the urging force of the compression spring. Then, there is a possibility that the secondary transfer outer roller is contacted to the intermediary transfer belt. For this reason, in the case where the secondary transfer outer roller is spaced from the intermediary transfer belt, the cam was rotated to the position where the load by the urging force of the compression spring such that the cam was rotated was not exerted on the cam.

In this case, during the spacing operation, the rotational load torque by the urging force of the compression spring acts on the cam, but when the secondary transfer roller (secondary transfer outer roller) is located at a spaced position, the rotational load torque is eliminated. That is, an abrupt torque (load) fluctuation is generated by the spacing operation. When such an abrupt load fluctuation is generated, vibration is generated at a driving portion where the spacing operation is performed, so that the vibration is transmitted to the intermediary transfer belt or an image forming portion. Accordingly, in the case where the spacing operation is performed in the image adjusting sequence, subsequent image formation is effected in a state in which the vibration is generated, so that there is a possibility that the vibration influences the image formation. Accordingly, in the case of the conventional structure, there is a need to effect formation of a subsequent normal image in consideration of a time of convergence of the vibration but correspondingly it takes a time for the image adjusting sequence, thus lowering productivity.

On the other hand, there is a constitution in which the patch is passed through a secondary transfer portion without spacing the secondary transfer roller and then the toner deposited on the secondary transfer roller is removed by a cleaning device for the secondary transfer roller, but correspondingly to the provision of the cleaning device, a cost is increased. Further, there is also a structure in which a bias of an opposite polarity to that during the transfer is applied to the secondary transfer portion without spacing the secondary transfer roller, but bias switching takes much time compared with the spacing operation of the secondary transfer roller and therefore the productivity is also lowered. Further, even under application of the bias of the opposite polarity, contamination of the secondary transfer roller cannot be avoided and therefore there is a need to provide the cleaning device for the secondary transfer roller, so that the cost is increased.

SUMMARY OF THE INVENTION

In view of the above-described circumstances, the present invention has been accomplished. A principal object of the present invention is to provide an image forming apparatus capable of realizing a structure capable of performing a spacing operation of a transfer member while suppressing a lowering in productivity.

According to an aspect of the present invention, there is provided an image forming apparatus comprising: an image bearing member for bearing and conveying a toner image; a transfer member for transferring the toner image, formed on the image bearing member, onto another image forming member by being supplied with a transfer bias in a state in which the transfer member is contacted to the image bearing member; and a contact-and-separation means for moving the transfer member toward and away from the image bearing member, wherein the contact-and-separation means includes: an urging member for urging the transfer member toward the image bearing member; a movement driving portion for driving the transfer member against an urging force of the urging member to move the transfer member; and a controller for controlling the movement driving portion so that the transfer member is locatable at a contact position where the transfer member is contacted to the image bearing member, a first spaced position where the transfer member is spaced from the image bearing member in a state in which a load by the urging force is exerted on the movement driving portion, and a second spaced position where the transfer member is spaced from the image bearing member in a state in which the load by the urging force is not exerted on the movement driving portion.

According to the present invention, at the first spaced position, the transfer member is spaced from the image bearing member in the state in which the load by the urging force of the urging member is exerted on the movement driving portion and therefore an abrupt load fluctuation is not generated, so that generation of vibration can be suppressed. For this reason, a lowering in productivity can be suppressed, e.g., when an image adjusting sequence at a sheet interval is performed at the first spaced position.

These and other objects, features and advantages of the present invention will become more apparent upon a consideration of the following description of the preferred embodiments of the present invention taken in conjunction with the accompanying drawings.

Figure 3:
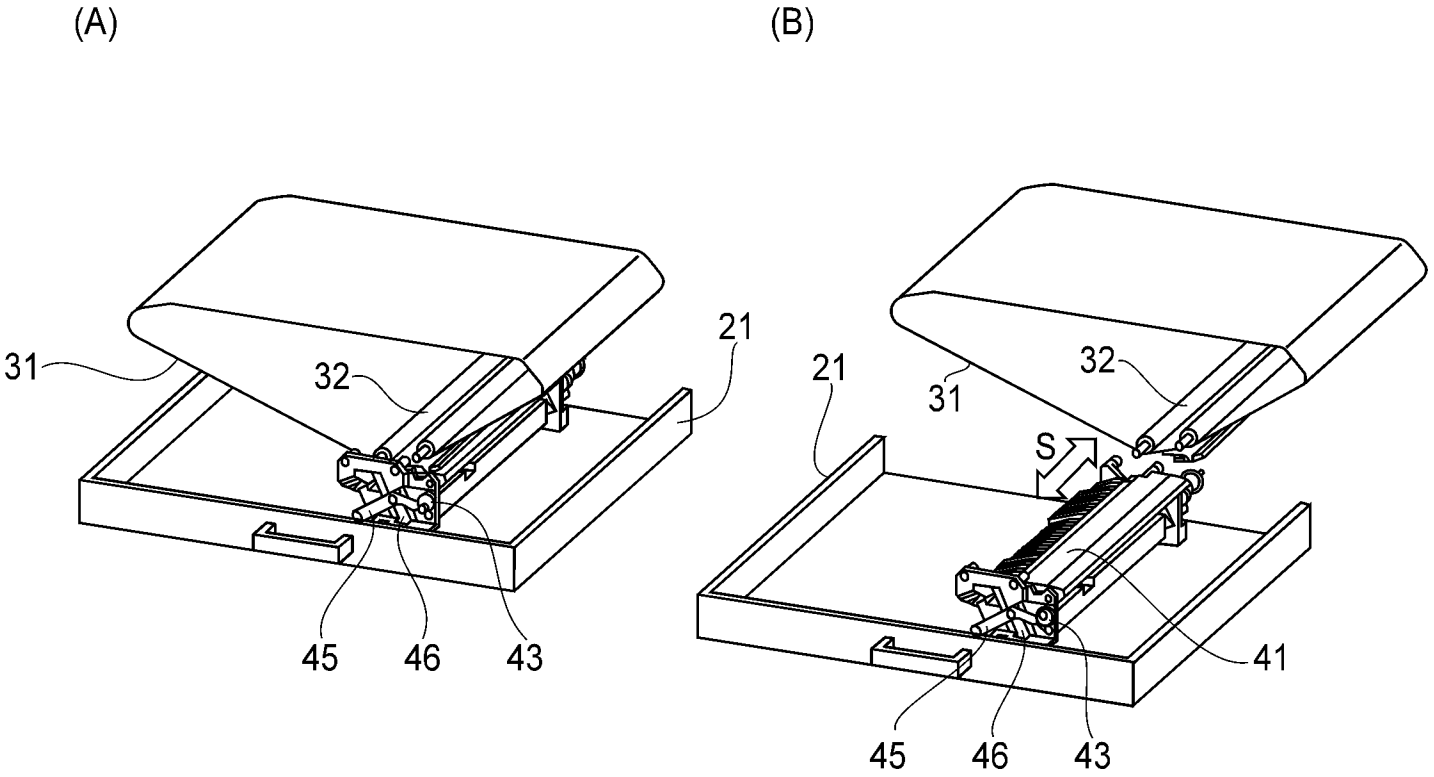

Part (A) of FIG. 3 is a perspective view showing a state in which a conveyance frame on which a secondary transfer outer roller is fixed is inserted with respect to an intermediary transfer belt, and (B) of FIG. 3 is a perspective view showing a state in which the conveyance frame is extracted from the intermediary transfer belt.

Figure 4:
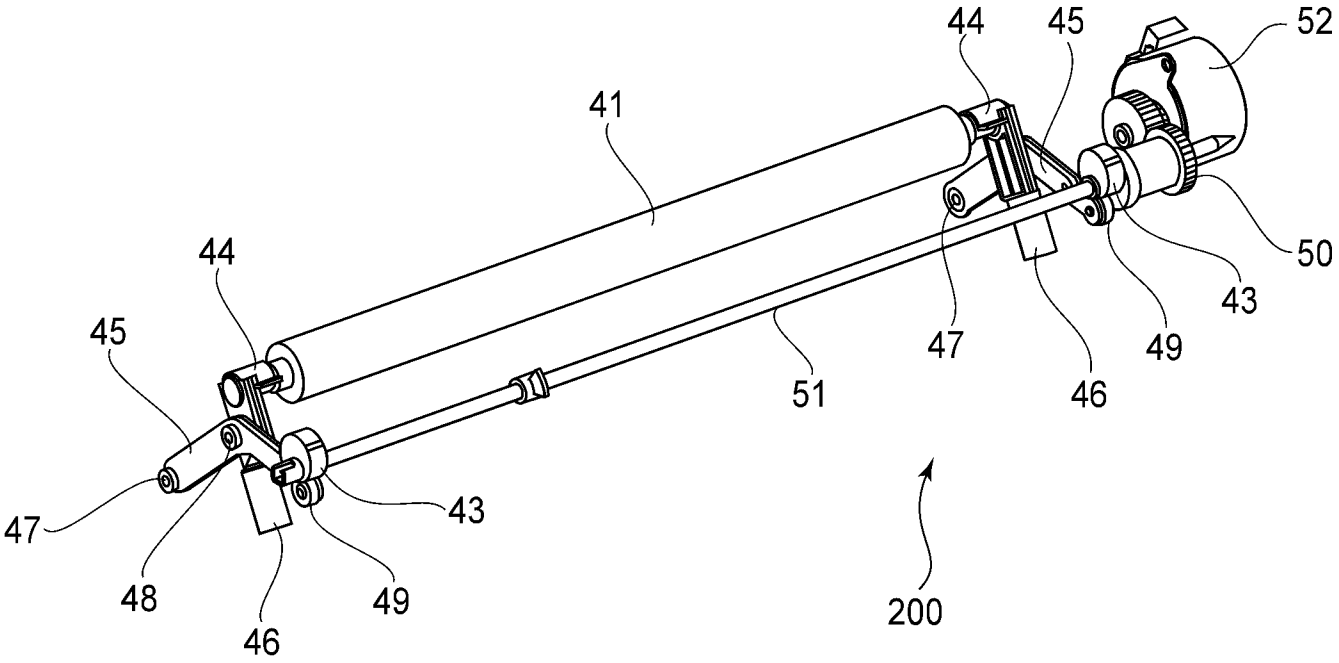

FIG. 4 is a perspective view showing a contact-and-separation mechanism for the secondary transfer outer roller.

Figure 5:
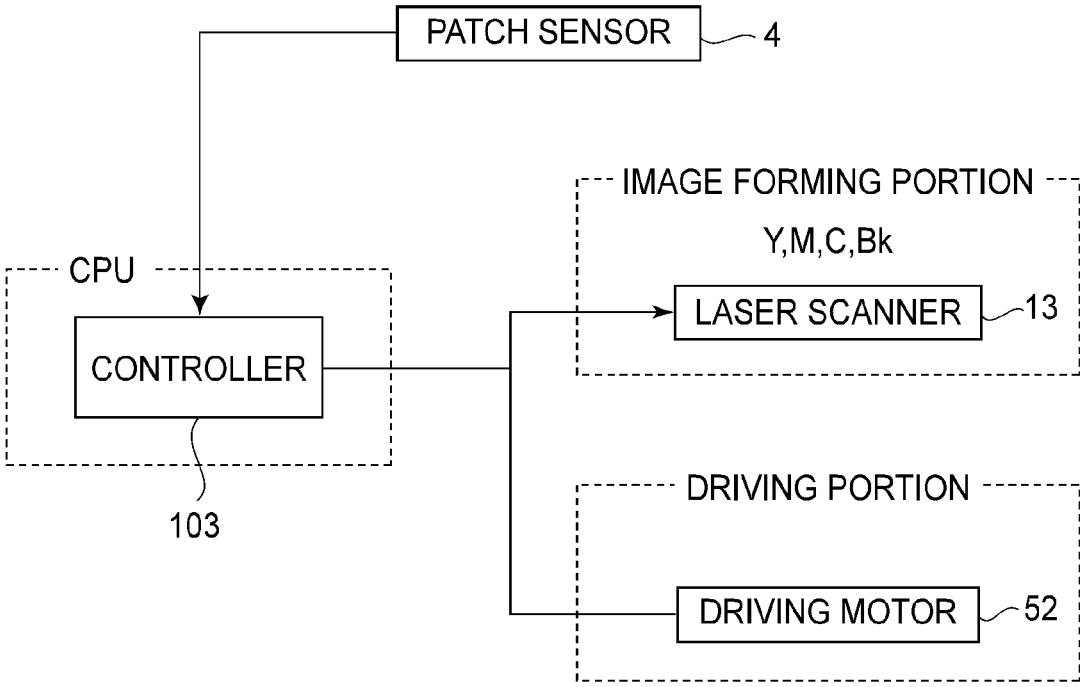

FIG. 5 is a control block diagram relating to an image adjusting sequence.

Figure 6:
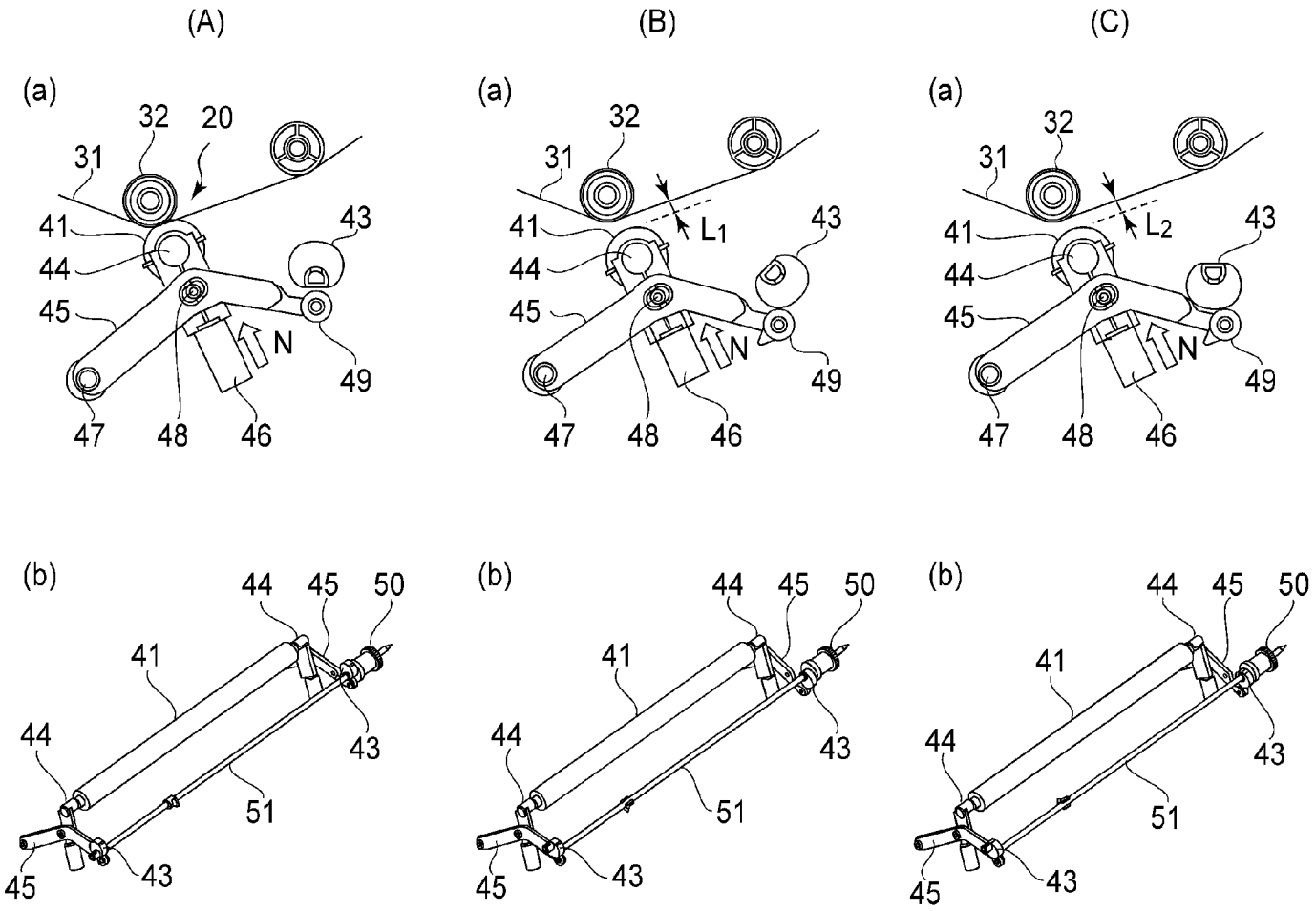

Parts (A), (B) and (C) of FIG. 6 are schematic views showing a secondary transfer portion or the contact-and-separation mechanism for the secondary transfer outer roller at a contact position, a first spaced position and a second spaced position, respectively, in which (a) of each of the parts (A), (B) and (C) is a schematic sectional view of the secondary transfer portion, and (b) of each of the parts (A), (B) and (C) is a perspective view of the contact-and-separation mechanism for the secondary transfer outer roller.

Figure 7:
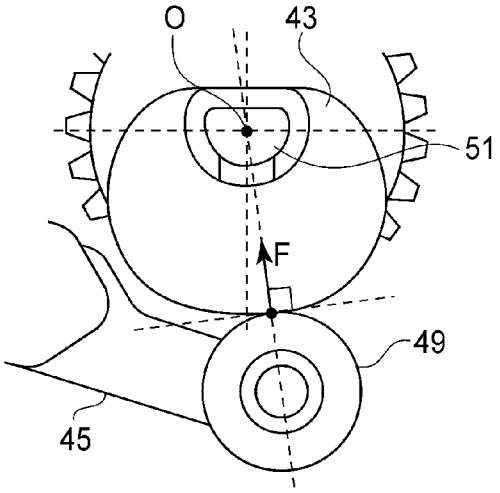

FIG. 7 is a schematic view showing a load state between a cam and a cam-receiving portion at the second spaced position.

Figure 8:
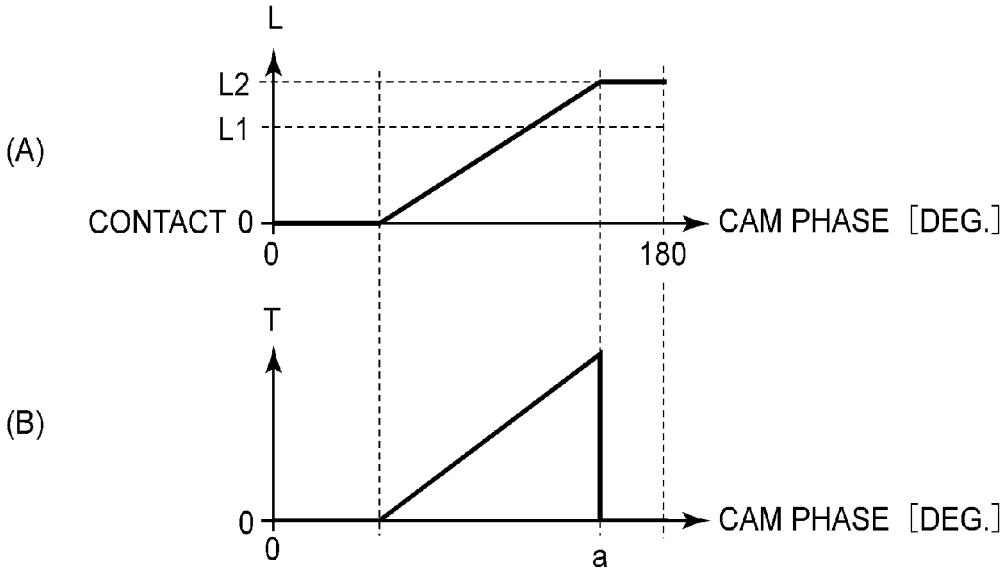

Parts (A) and (B) of FIG. 8 are graphs showing a relationship between a cam phase and a position of the secondary transfer outer roller and a relationship between the cam phase and a rotational load torque of the cam, respectively.

Figure 9:
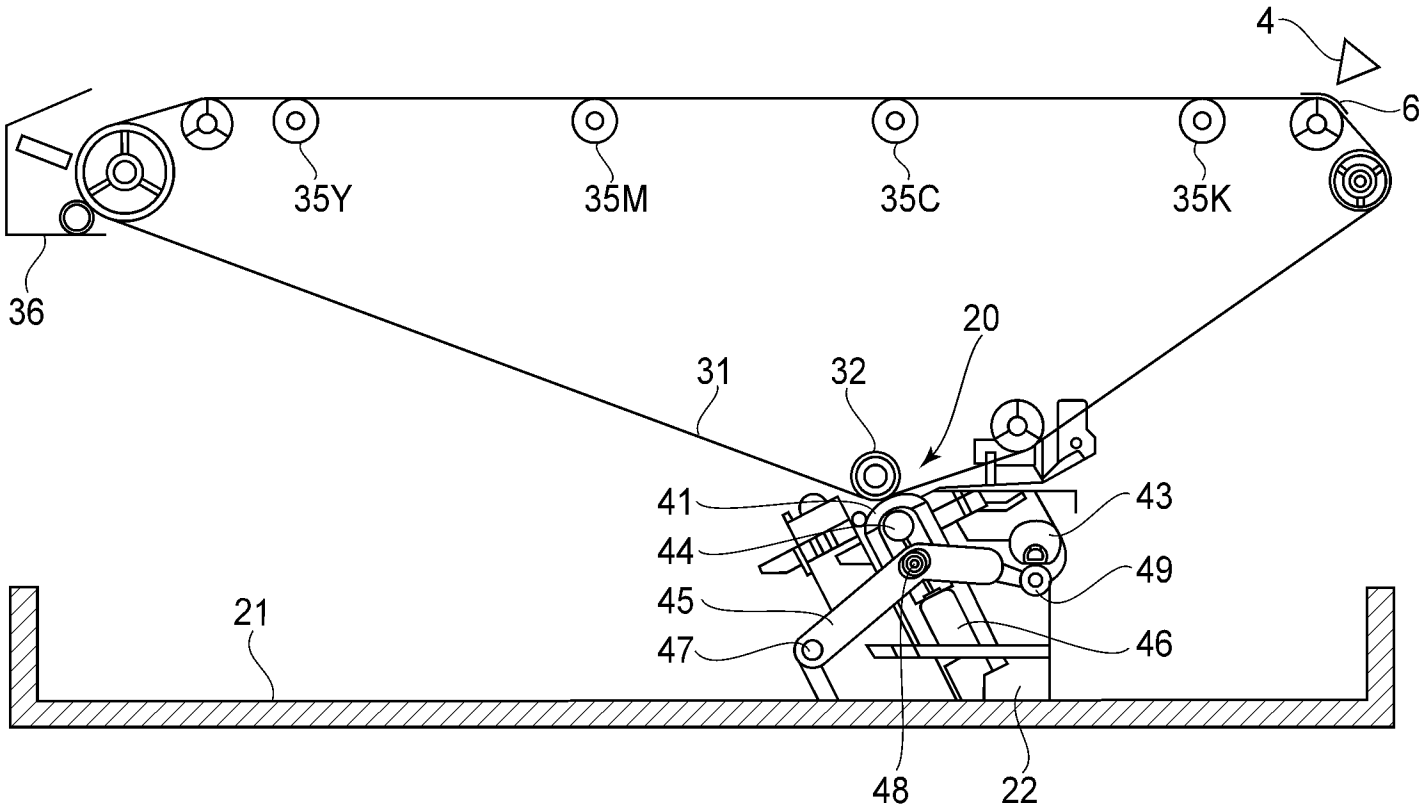

FIG. 9 is a schematic sectional view, of the intermediary transfer belt unit and the secondary transfer portion, showing a state when a patch reaches a sensor in the image adjusting sequence.

Figure 10:
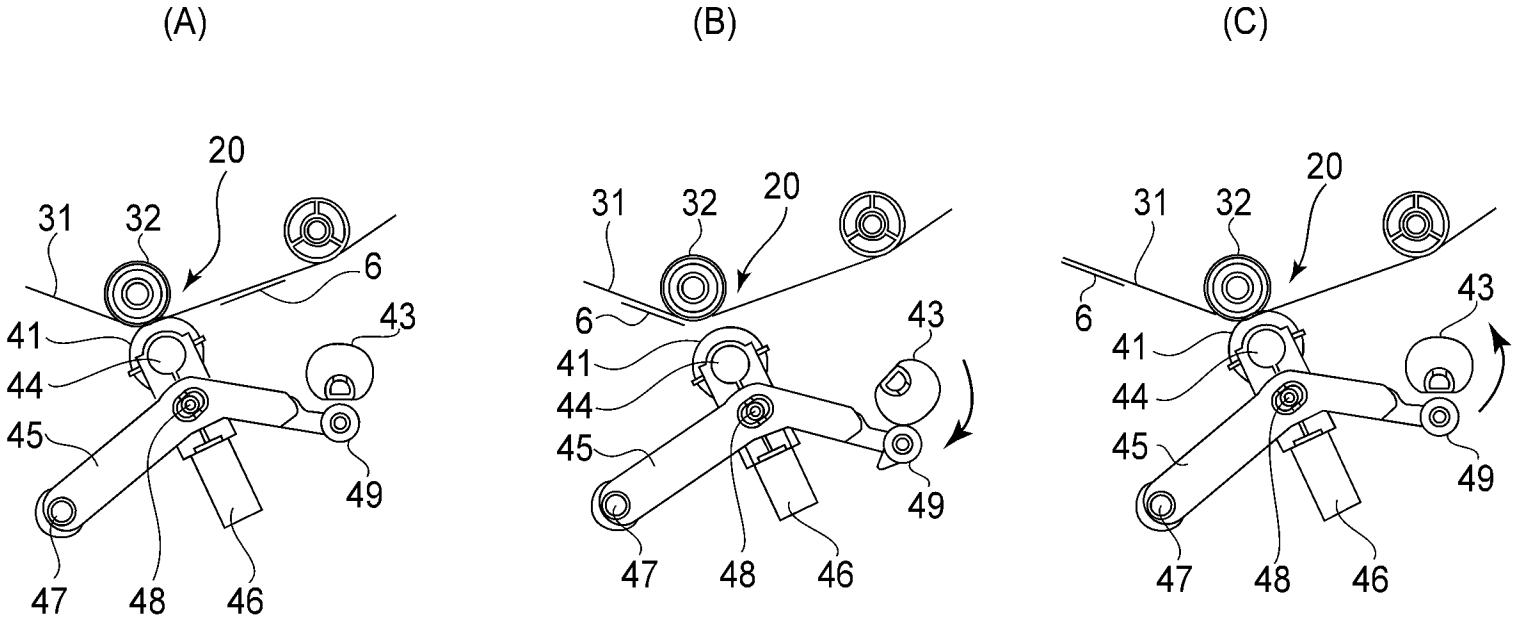

Parts (A), (B) and (C) of FIG. 10 are schematic views, of the secondary transfer portion, showing a state immediately before the patch reaches the secondary transfer portion, a state in which the patch passes through the secondary transfer portion, and a state immediately after the patch has passed through the secondary transfer portion, respectively.

Figure 11:
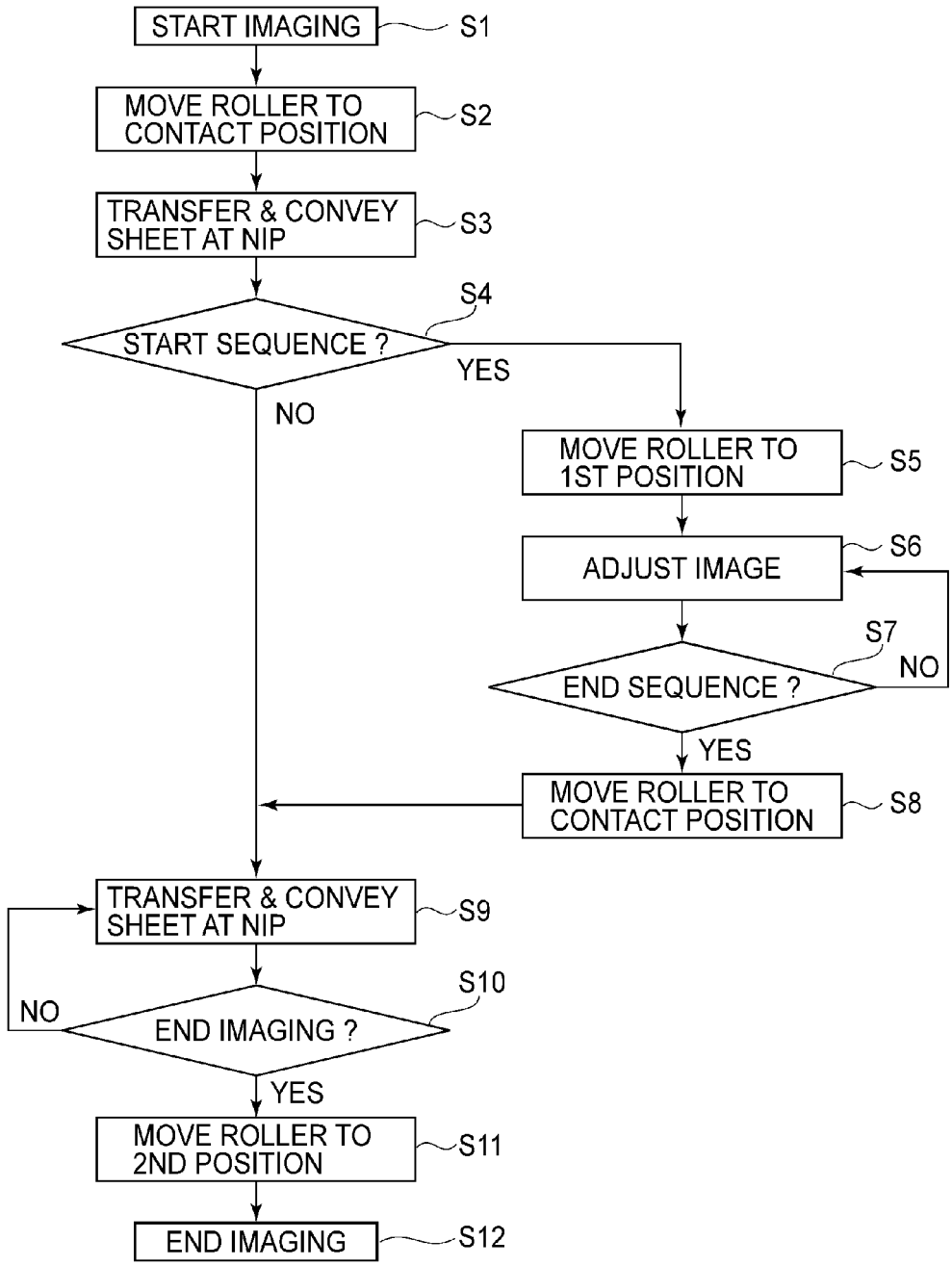

FIG. 11 is a flow chart showing a flow of control from start of image formation to end of the image formation in the embodiment.

Figure 12:
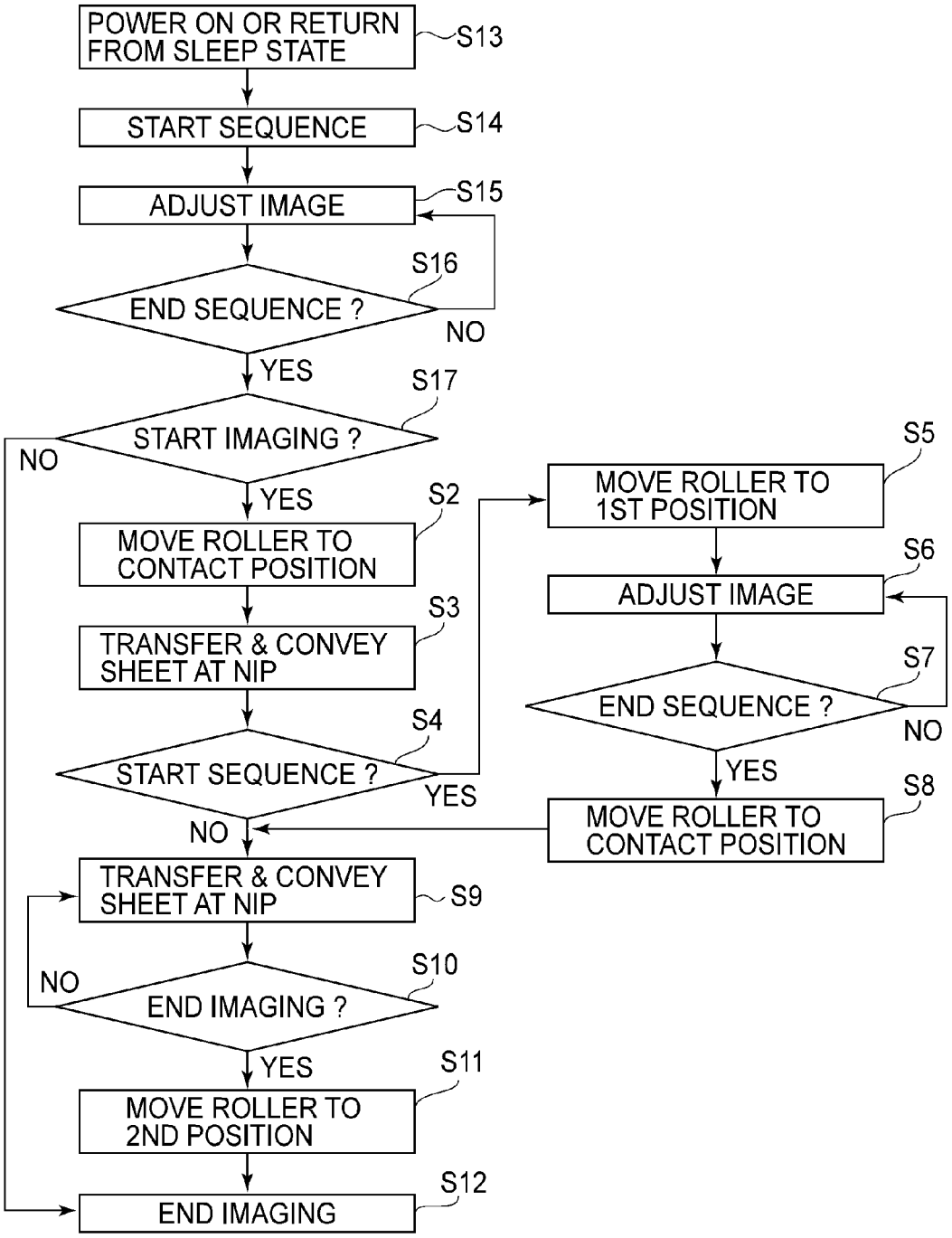

FIG. 12 is a flow chart showing a flow of control from power-on of the image forming apparatus to or return from a sleep state to the end of the image formation in the embodiment.

DESCRIPTION OF THE PREFERRED EMBODIMENTS

Embodiments of the present invention will be described with reference to FIGS. 1 to 12. First, a general structure of an image forming apparatus according to an embodiment of the present invention will be described with reference to FIG. 1.

[Image Forming Apparatus]

An image forming apparatus 100 is of a tandem type in which image forming portions 1Y, 1M, 1C and 1K for yellow (Y), magenta (M), cyan (C) and black (K), respectively, are juxtaposed along a rotational direction of an intermediary transfer belt 31 as an image bearing member. The image forming portions 1Y, 1M, 1C and 1K have the same constitution except that colors of toners used therein are different from each other. Therefore, in the following, constituent elements of the respective image forming portions will be described by omitting suffixes Y (yellow), M (magenta), C (cyan) and K (black) each for specifying an associated constituent element for the color, except for a necessary case.

The image forming portion 1 includes a photosensitive drum 11, and at a periphery of the photosensitive drum 11, includes a charger 12, a laser scanner 13 as an exposure device, a developing device 14 and a drum cleaning device 15. The charger 12 electrically charges the surface of the photosensitive drum 11 to have uniform electric charges. The surface of the photosensitive drum 11 is irradiated with laser light depending on an image signal for an associated color to neutralize the electric charges, so that an electrostatic latent image is formed on the photosensitive drum 11. The developing device 14 develops the electrostatic latent image with a toner of the associated color into a toner image.

The toner image formed on the photosensitive drum 11 by development is transferred onto the intermediary transfer belt 31, between the photosensitive drum 11 and a primary transfer roller 35 provided opposed to the photosensitive drum 11 via the intermediary transfer belt 31, by applying a primary transfer bias to the primary transfer roller 35. The toner images of the respective colors are successively transferred superposedly onto the intermediary transfer belt 31, so that a full-color toner image is formed on the intermediary transfer belt 31. The full-color toner image is conveyed to a secondary transfer portion 2. Incidentally, a transfer residual toner remaining on the photosensitive drum 11 without being transferred onto the intermediary transfer belt 31 is removed by the drum cleaning device 15.

The intermediary transfer belt 31 is stretched by stretching rollers consisting of a secondary transfer inner roller 32, a driving roller 33 and a steering roller 34. The secondary transfer inner roller 32 is provided at the secondary transfer portion 2. The driving roller 33 is rotationally driven by an unshown motor to rotate the intermediary transfer belt 31. The steering roller 34 is swung by an unshown swinging mechanism to control a position of the intermediary transfer belt 31 with respect to a widthwise direction.

On the other hand, a recording material (another image bearing member) P such as paper or a sheet conveyed from any of sheet-feeding cassettes 61, 62, 63 and 64 is conveyed toward a registration roller 75 by sheet pick-up rollers 71, 72, 73 and 74 and their downstream conveying rollers. Then, by the registration roller 75, the recording material P is conveyed to the secondary transfer portion 2 by being timed to the toner image on the intermediary transfer belt 31.

The toner image on the intermediary transfer belt 31 is transferred onto the recording material P by applying a secondary transfer bias between the intermediary transfer belt 31 and the secondary transfer outer roller 41 as a transfer member (secondary transfer image) provided at the secondary transfer portion 2. A transfer residual toner remaining on the intermediary transfer belt 31 without being transferred on the recording material P is removed by a belt cleaning device 36.

The recording material P on which the toner image is transferred is attracted by a front conveying unit 42 for a fixing device and is conveyed by the front conveying unit 42 from the secondary transfer portion 2 to a fixing device 5. Then, the recording material P is heated and pressed by the fixing device 5, so that the toner image is fixed on the recording material P. Thereafter, the recording material P passes through a sheet discharging conveying path 82 and is discharged to the outside of an apparatus main assembly 101. Here, in the case where the image formation is effected also in a non-image formation side of the recording material P, the recording material P is, after coming out of the fixing device 5, passed through a reversing conveying path 83 and a conveying path 85 for double side printing and there is conveyed to the registration roller 85. A subsequent process is as described above.

[Secondary Transfer Portion]

Figure 1:
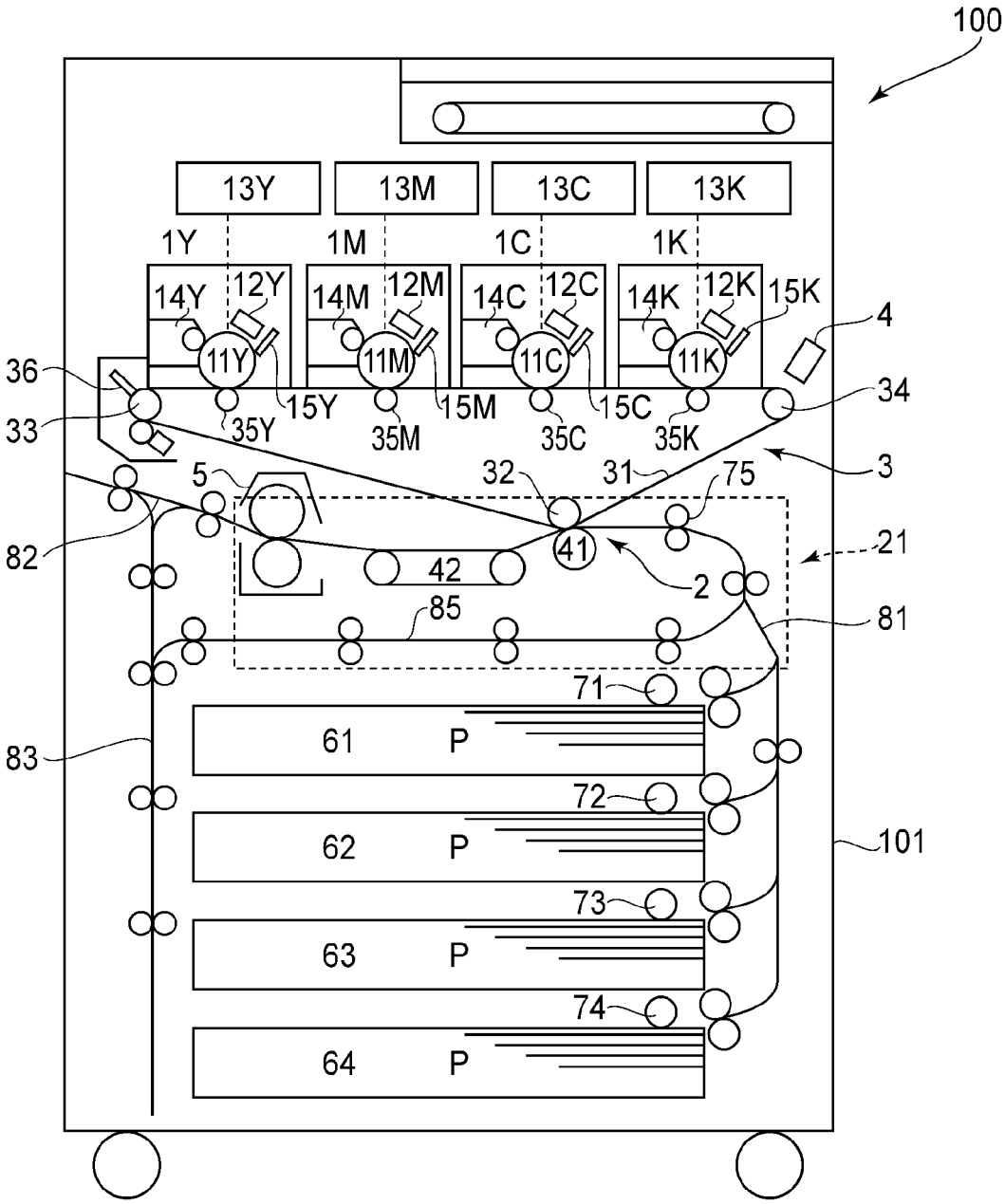
FIG. 1 is a schematic illustration of an image forming apparatus according to an embodiment of the present invention.
Figure 2:
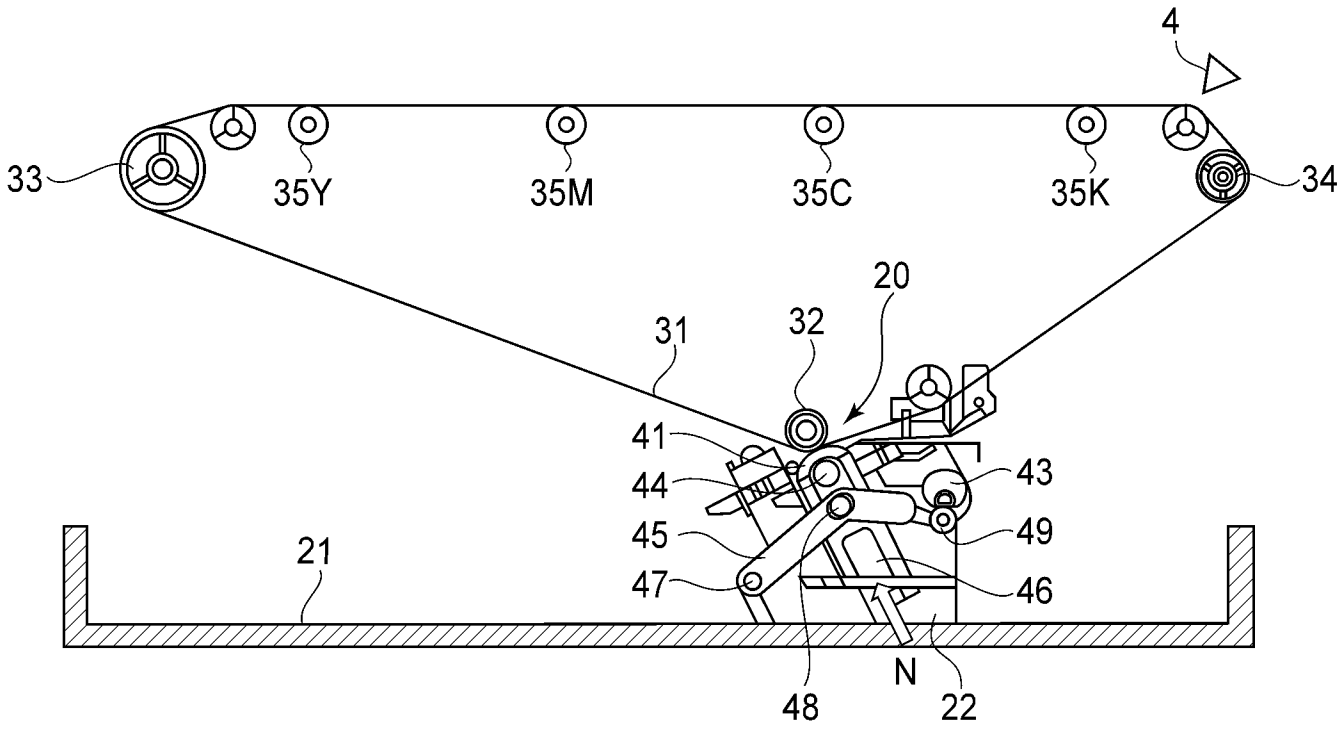
FIG. 2 is a schematic sectional view of an intermediary transfer belt unit and a secondary transfer portion.

Next, a constitution of the secondary transfer portion 2 where the toner image is transferred from the intermediary transfer belt 31 onto the recording material P will be described with reference to FIGS. 2 to 4. FIG. 2 is a sectional view showing a state during an image forming job (image formation). The secondary transfer outer roller 41 is, as shown in FIGS. 2 and 4, rotatably held at its end portions by a roller holder 44, and the roller holder 44 is urged in an arrow N direction by a compression spring 46 as an urging member. As a result, the secondary transfer outer roller 41 is urged toward the intermediary transfer belt 31 to nip the intermediary transfer belt 31 between itself and the secondary transfer inner roller 32, thus forming a secondary transfer nip 20.

Parts (A) and (B) of FIG. 3 are perspective views of the intermediary transfer belt unit 3 and the secondary transfer portion 2, in which (A) shows the state during the image forming job, and (B) shows a state in which a conveyance frame 21 is pulled out for accessing to a transfer conveyance portion during jam clearance or during maintenance. The conveyance frame 21 is constituted movably in an arrow S direction (front-rear direction of the apparatus main assembly) and can be inserted into and extracted from the apparatus main assembly 101. The secondary transfer outer roller 41 is fixed to the conveyance frame 21, and by pulling out the conveyance frame 21 from the apparatus main assembly 101, also the secondary transfer outer roller 41 is pulled out. At this time, when the secondary transfer outer roller 41 is contacted to the intermediary transfer belt 31, there is a possibility that the secondary transfer outer roller 41 damages the intermediary transfer belt 31 and therefore there is a need to keep the secondary transfer outer roller 41 is a spaced state from the intermediary transfer belt 31.

Further, also in this embodiment, in order to stabilize an image quality, an image adjusting sequence such as image density adjustment or color misregistration adjustment is periodically performed depending on a predetermined print number or a predetermined print time. In this case, when a patch transferred on the intermediary transfer belt 31 (image bearing member) passes through the secondary transfer portion 2, in order to avoid toner contamination on the secondary transfer outer roller 41, the secondary transfer outer roller 41 is required to be spaced from the intermediary transfer belt 31.

[Contact-and-Separation Mechanism for Secondary Transfer Outer Roller]

As described above, depending on each of during the image formation, during the jam clearance or maintenance, and during the image adjustment, the secondary transfer outer roller 41 is required to be contacted (press-contacted) to or spaced (demounted) from the intermediary transfer belt 31. Accordingly, next, a contact-and-separation mechanism 200 as a contact-and-separation means for moving the secondary transfer outer roller 41 toward and away from the intermediary transfer belt 31 will be described with reference to FIGS. 2 and 4.

The roller holder 44 for holding the secondary transfer outer roller 41 at each end of the secondary transfer outer roller 41 includes an engaging portion 48 for being engaged with a mounting and demounting arm 45. The mounting and demounting arm 45 is held rotatably, in its end side, about a mounting and demounting rotational movement shaft 47 provided and projected from a secondary transfer outer frame 22 fixed to the conveyance frame 21, and includes a cam receiving portion 49 in its other end side. Further, a mounting and demounting shaft 51 is held rotatably by the secondary transfer outer frame 22, and to the mounting and demounting shaft 51, a cam 43 and a gear 50 are fixed. In a rear side of the image forming apparatus 100, a driving motor 52 is provided, a rotational driving force is transmitted from the driving motor 52 to the gear 50. By rotation of the gear 50, also the mounting and demounting shaft 51 and the cam 43 are rotated.

By the compression spring 46, the roller holder 44 is urged toward the intermediary transfer belt 31 and therefore also the mounting and demounting arm 45 engaged with the roller holder 44 is urged rotationally about the mounting and demounting shaft 47 toward the intermediary transfer belt 31. Then, in another end side of the mounting and demounting arm 45, the cam receiving portion 49 is press-contacted to the cam 43. The cam 43 is arbitrarily changed, depending on its phase, in distance from the mounting and demounting shaft 51 as a rotation center of the cam 43 to an outer diameter surface. Accordingly, by rotating the cam 43 to an arbitrary phase by the driving motor 52, the cam receiving portion 49 can be moved against an urging force of the compression spring 46. As a result, the mounting and demounting arm 45 is rotationally moved about the mounting and demounting shaft 51, so that the roller holder 44 and the secondary transfer outer roller 41 which are engaged at the engaging portion 48 are moved in a direction in which the secondary transfer outer roller 41 is mounted (contacted) to and demounted (spaced) from the intermediary transfer belt 31. That is, the cam 43 is rotated against the urging force of the compression spring 46 to change its phase, so that the position of the secondary transfer outer roller 41 is changeable. The driving motor 52 is, as shown in FIG. 5, controlled by a controller 103 as a controlling portion.

In this embodiment, the contact-and-separation mechanism 200 is thus constituted, so that the secondary transfer outer roller 41 is contacted to and spaced from the intermediary transfer belt 31. Further, the cam 43 as a movement driving portion can move the secondary transfer outer roller 41 against the urging force of the compression spring 46 by the driving motor 52, the gear 50 and the mounting and demounting shaft 51. Incidentally, the cam 43, the roller holder 44, the mounting and demounting arm 45 and the compression spring 46 which are described above are disposed in each of front and rear sides of the apparatus main assembly 101.

[Position of Secondary Transfer Outer Roller]

Such a contact-and-separation mechanism 200 is controlled so that the secondary transfer outer roller 41 is locatable at a contact position, a first spaced position and a second spaced position. Here, the contact position is a position where the secondary transfer outer roller 41 is contacted to the intermediary transfer belt 31. Further, the first spaced position is a position where the secondary transfer outer roller 41 is spaced from the intermediary transfer belt 31 in a load state in which a load by the urging force of the compression spring 46 is exerted on the movement driving portion, i.e., in a state in which a rotational load torque is exerted on the cam 43 as described later. Further, the second spaced position is a position where the secondary transfer outer roller 41 is spaced from the intermediary transfer belt 31 in a non-load state in which the load by the urging force of the compression spring 46 is not exerted on the movement driving portion, i.e., in a state in which the rotational load torque is not exerted on the cam 43. In the following, a positional relationship among these positions will be described with reference to FIGS. 6 to 8.

Part (A) of FIG. 6 shows a state of the contact position where the secondary transfer outer roller 41 is contacted to the intermediary transfer belt 31. Part (B) of FIG. 6 shows a state of the first spaced position where the secondary transfer outer roller 41 is spaced from the intermediary transfer belt 31 in the load state. Part (C) of FIG. 6 shows a state of the second spaced position where the secondary transfer outer roller 41 is spaced from the intermediary transfer belt 31 in the non-load state. When a distance from the intermediary transfer belt 31 to the secondary transfer outer roller 41 is defined as L (hereinafter referred to as a spacing amount L), L in the state of the first spaced position is $L_1$, and L in the state of the second spaced position is $L_2$. In this case, $L_1<L_2$ is satisfied. That is, the second spaced position is a position where the secondary transfer outer roller 41 is spaced from the intermediary transfer belt 31 more than at the first spaced position. In this embodiment, e.g., $L_1$ and $L_2$ are constituted so as to be $L_1=4.5$ (mm) and $L_2=5.0$ (mm). $L_1$ is a position where the secondary transfer outer roller 41 is sufficiently spaced from a patch toner image described later to prevent the secondary transfer outer roller 41 from being contaminated with the toner with reliability, and $L_2$ is a position where $L_2-L_1>0$ is satisfied as described later.

For this reason, in this embodiment, the cam 43 for moving the secondary transfer outer roller 41 is constituted as follows. That is, the cam 43 is capable of moving, when its phase is within the predetermined range, the secondary transfer outer roller 41 between the contact position and the first spaced position in the state in which the urging force of the compression spring 46 is exerted on the cam 43. Further, the cam 43 is capable of positioning, when its phase is out of the predetermined range, the secondary transfer outer roller 41 at the second spaced position in the state in which the urging force of the compression spring 46 is not exerted on the cam 43.

Specifically, the cam 43 has an outer diameter shape as shown in FIG. 7. FIG. 7 shows a state when the phase of the cam 43 provides the second spaced position. The cam 43 is molded so that the outer diameter shape thereof is, in a specific phase providing the second spaced position, so that a direction of an urging force F received from the compression spring 46 via the mounting and demounting arm 45 passes through a center point O of the mounting and demounting shaft 51. As a result, in the state of the second spaced position, the urging force of the compression spring 46 is supported by the mounting and demounting shaft 51 via the cam 43, so that the cam 43 is held in the state in which there is no rotational load torque.

Further, the cam 43 is, when the cam is in a predetermined range from a phase where the cam 43 starts contact with the cam receiving portion 49 of the mounting and demounting arm 45 until a phase upstream of the above-described specific phase with respect to a rotational direction of the cam 43, in a state in which the cam 43 receives the urging force F from the compression spring 46 via the mounting and demounting arm 45. Accordingly, in the phase in which the phase of the cam 43 is within the predetermined range, the first spaced position is set.

Such a position of the secondary transfer outer roller 41 is set as shown in FIG. 8. Parts (A) and (B) of FIG. 8 are graphs of the spacing amount T between the secondary transfer outer roller 41 and the intermediary transfer belt 31 and a rotational load torque T exerted on the cam 43, respectively, when the phase of the cam 43 is taken as the abscissa in the case where the secondary transfer outer roller 41 is mounted and demounted. In this embodiment, the cam 43 is molded in the outer diameter shape such that the phase of the cam 43 at the second spaced position shown in (C) of FIG. 6 is 180 (degrees) when the phase of the cam 43 at the contact position shown in (A) of FIG. 6 is taken as 0 (degrees).

In the state of the contact position, the secondary transfer outer roller 41 is press-contacted to the intermediary transfer belt 31, so that the cam receiving portion 49 is held at a position where the cam receiving portion 49 does not contact the outer peripheral surface of the cam 43. When the cam 43 is rotated from this state to start the spacing of the secondary transfer outer roller 41, as shown in the graph of (B) of FIG. 8, the rotational load torque T rises from a zero (no load) state. When the cam 43 is continuously rotated to start contact of the cam receiving portion 49 with the outer peripheral surface of the cam 43, the urging force of the compression spring 46 is applied to the cam 43 to generate the rotational load torque T. Then, when the cam 43 is further rotated continuously 180 (degrees), the secondary transfer outer roller 41 reaches the second spaced position. In this state, in order to pull out the conveyance frame 21 during the jam clearance or during the maintenance, there is a need to hold the cam 43 in a state in which there is no rotational load by the urging force of the compression spring 46. In this embodiment, as described above, at the second spaced position, the cam is in the no-load state.

Thus, the rotational load on the cam 43 at the second spaced position is eliminated, so that when the phase of the cam 43 reaches the second position, as shown in (B) of FIG. 8, the rotational load torque T is non-continuously switched from the load state to the non-load state. Hereinafter, the phase of the cam 43 at this time is referred to as a switching point a. Accordingly, in the case where the secondary transfer outer roller 41 is moved between the second spaced position and the contact position, when the phase of the cam 43 passes through the switching point a, an abrupt load fluctuation is exerted on the cam 43, so that mechanical vibration (hereinafter referred to as mounting and demounting vibration) is caused to be generated. Particularly, in mounting and demounting during execution of the image adjusting sequence, there is a need to resume the image formation immediately after end of the image adjusting sequence in order to reduce a lowering in productivity. For this reason, when the secondary transfer outer roller 41 is moved to the second spaced position, the mounting and demounting vibration influences the image formation, so that the lowering in image quality occurs.

Therefore, in this embodiment, in the mounting and demounting during the image adjusting sequence, the secondary transfer outer roller 41 is moved to the first spaced position at the most to be prevented from passing through the switching point a, so that the mounting and demounting with no mounting and demounting vibration is realized. In other words, the cam phase providing the first spaced position is set within a range in which the rotational load torque T is moderately changed. Specifically, the phase of the cam 43 at the distance $L_1$ (=4.5 mm) providing the first spaced position is set at 130 (degrees), and the phase of the cam 43 at the distance $L_2$ (=5.0 mm) providing the second spaced position is set at 155 (degrees).

Here, when $L_2-L_1$ is excessively large, a movement amount of the secondary transfer outer roller 41 becomes large, so that there is a need to create a space for such movement and thus upsizing of the apparatus is invited. Further, when the movement amount becomes large, an output of the driving motor 52 is required to be increased correspondingly, thus leading to an increase in cost. Accordingly, $L_2-L_1$ may desirably be small to the possible extent. However, when $L_2-L_1$ is excessively small, due to an error, there is a possibility that the secondary transfer outer roller 41 intended to reach the first spaced position reaches the second spaced position. Therefore, in this embodiment, in consideration of molding variation of shapes of parts for performing a mounting and demounting operation and control variation of the mounting and demounting operation, $L_2-L_1=0.5$ (mm) is set in order to realize $L_2-L_1>0$ with reliability.

[Mounting and Demounting Operation in Image Adjusting Sequence]

Next, in the case where the image adjusting sequence such as image density adjustment or color misregistration adjustment is periodically executed depending on a predetermined print number and a predetermined print time in order to stabilize the image quality, the mounting and demounting operation of the secondary transfer outer roller 41 will be described.

During consecutive image formation, normal images are consecutively formed on the intermediary transfer belt 31 (image bearing member). A patch toner image 6 for adjusting the image is formed at an interval between two normal images (hereinafter referred to as a sheet interval). Then, the normal images are transferred from the intermediary transfer belt 31 onto the recording material, and the patch toner image 6 is not transferred onto the recording material. Such a patch toner image 6 is read by a patch sensor 4 provided at a position opposing a surface of the intermediary transfer belt 31 in a downstream side of the image forming portions. A signal of the patch sensor 4 is, as shown in FIG. 5, sent to the controller 103. The controller 103 controls the laser scanner 13 and the like of each image forming portion depending on the signal, thus adjusting the density and position of the image.

Further, the controller 103 controls the driving motor 52 in the image adjusting sequence to appropriately move the secondary transfer outer roller 41. That is, when the normal image reaches the secondary transfer portion 2 as a transfer position where the secondary transfer outer roller 41 is located, the secondary transfer outer roller 41 is positioned at the contact position. Further, during passing of the patch toner image 6 through the secondary transfer portion 2, the secondary transfer outer roller 41 is positioned at the first spaced position. Further, during non-image formation, e.g., before the image forming job is started or after the image forming job is ended, the secondary transfer outer roller 41 is positioned at the second spaced position. In the following, description will be made specifically with reference to FIGS. 9 and 10.

FIGS. 9 and 10 are schematic views when the patch toner image 6 transferred on the intermediary transfer belt 31 is conveyed during execution of the image adjusting sequence. When the image adjusting sequence is started, the patch toner image 6 formed at the sheet interval is transferred onto the intermediary transfer belt 31 and then is, as shown in FIG. 9, conveyed to a reading position of the patch 4 by the intermediary transfer belt 31. Then, an amount of the density variation and an amount of the color misregistration of the patch toner image 6 are detected by the patch sensor 4, and these amounts are corrected at the time of image formation after the image adjustment to effect image formation.

The patch toner image 6 passing through the reading position of the patch sensor 4 is further conveyed by the intermediary transfer belt 31 to a position immediately before the secondary transfer outer roller 41 as shown in (A) of FIG. 10. At this time, the secondary transfer outer roller 41 is located at the contact position. Then, the cam 43 is rotated in an arrow direction indicated in (B) of FIG. 10, so that the secondary transfer outer roller 41 is moved to the first spaced position before the patch toner image 6 reaches the secondary transfer portion 20. Then, as shown in (B) of FIG. 10, the patch toner image 6 passes through the secondary transfer portion 20 in a state in which the secondary transfer outer roller 41 is spaced from the intermediary transfer belt 31. At a time when a predetermined time is elapsed from the passing of the secondary transfer outer roller 41 through the secondary transfer portion 20, the cam 43 is rotated in an arrow direction indicated in (C) of FIG. 10, so that the secondary transfer outer roller 41 is moved to the contact position as shown in (C) of FIG. 10. Thus, the secondary transfer portion 20 is formed, so that a state in which transfer and conveyance of the normal image onto the recording material can be started is created. Further, the patch toner image 6 passed through the secondary transfer portion 20 is conveyed to the belt cleaning device 36, thus being removed from the intermediary transfer belt 6.

In this embodiment, a length of the sheet interval where the patch toner image 6 is to be formed is 260 mm. This is because the sheet interval corresponds to 747 (msec) when converted into a passing time of the secondary transfer portion 20 and therefore there is a need to space the secondary transfer outer roller 41 from the contact state and then is placed in the contact state again within 747 (msec). At this time, when the secondary transfer outer roller 41 is moved to the second spaced position, the mounting and demounting vibration as described above is generated and therefore there is a possibility that the vibration adversely affects the formation of a subsequent normal image. On the other hand, as in this embodiment, when the secondary transfer outer roller 41 is moved from the contact position to the first spaced position and then is moved from the first spaced position to the contact position, there is no abrupt load fluctuation and thus the mounting and demounting vibration can be suppressed. For this reason, even when the image adjusting sequence is executed in the sheet interval as described above, the influence on the formation of the subsequent normal image can be reduced. Incidentally, the sheet interval length in which the patch toner image 6 is formed is not limited to the above-described length but may also be set appropriately depending on the size and number of the patch toner image, required correction accuracy during the image adjustment, and a demand on productivity of image formation in consideration of an image adjusting time.

Next, a flow from start of image formation to end of the image formation in this embodiment will be described with reference to FIG. 11. When the image formation is started (S1), the controller 103 actuates the driving motor 52 to move the secondary transfer outer roller 41 to the contact position (S2). Then, at the secondary transfer portion (nip) 20, the image is transferred onto the recording material (S3). In the case where image formation of a predetermined number of sheets is effected during consecutive image formation, when the image adjusting sequence is started (S4), the secondary transfer outer roller 41 is moved to the first spaced position by the driving motor 52, thus being spaced from the intermediary transfer belt 31 (S5). At this time, the patch toner image 6 is read by the patch sensor 4, and a read result is fed back to the controller 103, so that image adjustment in which a correction value during image formation is set to the laser scanner 13 is performed (S6). After the patch toner image 6 is read by the patch sensor 4, the patch toner image 6 passes through the secondary transfer portion 2 and then is removed from the intermediary transfer belt 31 by the belt cleaning device 36.

When the image adjustment is ended, i.e., when all the patch toner images 6 formed at the sheet intervals pass through the secondary transfer portion (S7), the secondary transfer outer roller 41 is moved to the contact position by the driving motor 52 (S8). Then, the image formation is resumed, so that the normal image is transferred onto the recording material at the secondary transfer nip 20 (S9). When the image formation is ended (S10), the secondary transfer outer roller 41 is moved to the second spaced position by the driving motor 52 (S11), so that the image formation is ended (S12).

The process from the start of the image formation to the end of the image formation is described above, but a flow during main switch on of the image forming apparatus or during return from a sleep state is as shown in FIG. 12. That is, there is also the case where the image adjusting sequence such as the image density adjustment or the color misregistration adjustment performed when the main switch of the image forming apparatus is turned on or when the apparatus main assembly is returned from a state in which the apparatus main assembly is in the sleep state and is not used for a long period, and then is used again, is performed. Also in this case, the mounting and demounting operation of the secondary transfer outer roller 41 is performed in order to avoid the toner contamination.

First, when the main switch of the apparatus main assembly is turned on or when the apparatus main assembly is returned from the sleep state (S13), the image adjusting sequence is started (S14). In this state, the secondary transfer outer roller 41 is located at the second spaced position. In this state, the image adjustment such that the patch toner image 6 is read by the patch sensor 4 and a read result is fed back to the controller 103 and then a correction value during image formation is set to the laser scanner 13 is performed (S15). The patch toner image 6 is, after being read by the patch sensor 4, passed through the secondary transfer portion 2 and then is removed from the intermediary transfer belt 31 by the belt cleaning device 36. Such an image adjusting sequence during the turning-on of the main switch or during the return from the sleep state is ended (S16), and then in the case where the image formation is started (S17), the above-described steps S2 to S12 in FIG. 11 are executed.

Whether or not the image adjusting sequence is performed when the apparatus main assembly is in the state in which the apparatus main assembly is placed in the sleep state for a long term and then is used again is discriminated by measuring a temperature of the fixing device 5. In this embodiment, in the case where the temperature of the fixing device 5 is 100° C. less, the image adjusting sequence is performed. However, a discrimination factor described above is not limited to the fixing device temperature, but e.g., a timer provided to the apparatus main assembly may also be used.

According to this embodiment constituted as described above, at the first spaced position, the secondary transfer outer roller 41 is spaced from the intermediary transfer belt 31 in the state in which the load by the urging force of the urging member is exerted on the cam 43, and therefore an abrupt load fluctuation is not generated, so that the generation of the vibration can be suppressed. For this reason, when the image adjusting sequence at the sheet interval is executed at the first spaced position as described above, a lowering in productivity can be suppressed. That is, when the patch toner image 6 passes through the secondary transfer portion 2, the secondary transfer outer roller 41 is spaced from the intermediary transfer belt 31 for preventing the toner contamination, but this spaced position is set at the first spaced position where the load fluctuation is not generated. For this reason, the mounting and demounting vibration can be suppressed and the influence on the image formation of the normal image can be reduced. As a result, it is possible to realize the image forming apparatus capable of keeping a good image quality while suppressing the lowering in productivity.

Further, when the patch toner image 6 passes through the secondary transfer portion 2, the secondary transfer outer roller 41 is spaced from the intermediary transfer belt and therefore the secondary transfer outer roller 41 can be prevented from being contaminated with the toner. Accordingly, there is no need to provide a device for cleaning the secondary transfer outer roller 41, so that an increase in cost can be suppressed.

Incidentally, the present invention may preferably be applicable to not only the secondary transfer portion of the image forming apparatus of the tandem type and the intermediary transfer type as described above but also a constitution in which the transfer member is contacted to and spaced from the image bearing member at the image transfer portion.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 103006/2012 filed Apr. 27, 2012, which is hereby incorporated by reference.

What is claimed is:

1. An image forming apparatus comprising:

an image bearing member configured to bear and convey a toner image;

a transfer member configured to transfer the toner image formed on said image bearing member onto a recording material at a transfer portion;

a contact-and-separation unit configured to move said transfer member between a contact position where said transfer member contacts said image bearing member, a first spacing position where said transfer member is separated from said image bearing member at a first interval, and a second spacing position where said transfer member is separated from said image bearing member at a second interval larger than the first interval, said contact-and-separation unit including a movable supporting member configured to support said transfer member, an urging member configured to urge said supporting member so that said transfer member is urged toward said image bearing member, a cam configured to abut an abutted portion of said supporting member and configured to move said supporting member by being rotated about a rotation center against an urging force of said urging member, and a driving unit configured to rotate said cam;

an adjustment toner forming portion configured to form an adjustment toner on said image bearing member in a region between a toner image to be transferred to a recording material and a toner image to be transferred to a following recording material;

a detecting member configured to detect the adjustment toner formed on said image bearing member;

a changing portion configured to change an image forming condition based on a result of said detecting member; and a control portion configured to control said driving unit so that said transfer member is located in the contact position during a period in which the toner image to be transferred onto the recording material passes through the transfer portion, and so said transfer member is located in the first spacing position during a period in which the adjustment toner passes through the transfer portion, and configured to control said driving unit so that said cam is stopped at any one of three phases of a first phase corresponding to the contact position, a second phase corresponding to the first spacing position, and a third phase corresponding to the second spacing position when said cam is rotated in a rotation range from the first phase to the third phase via the second phase, wherein said cam has a shape such that a distance between its outer circumference at the abutted portion and the rotation center continuously increases in a phase range from the first phase toward the third phase via the second phase when said cam is rotated from the first phase to the third phase in the rotation range.

2. An apparatus according to claim 1, wherein when said transfer member is moved from the second spacing position to the contact position, said cam has a shape such that the distance between its outer circumference at the abutted portion and the rotation center continuously decreases in a phase range from the third phase toward the first phase via the second phase when said cam is rotated from the third phase to the first phase in the rotation range.

3. An apparatus according to claim 1, wherein when a phase of said cam is the third phase, the distance does not change with the rotation of said cam.

4. An apparatus according to claim 3, wherein said control portion controls said driving unit so that a rotation angle of said cam when said transfer member is moved from the contact position to the second spacing position is larger than a rotation angle of said cam when said transfer member is moved from the contact position to the first spacing position.

* * * * *